US007878118B2

(12) United States Patent
Hart et al.

(10) Patent No.: US 7,878,118 B2
(45) Date of Patent: Feb. 1, 2011

(54) CIRCUMFERENTIAL REGISTER FOR A ROTARY PRESS

(75) Inventors: Michael Hart, Channahon, IL (US); Carlos F. Noa, Plainfield, IL (US); Greg Tabor, Downers Grove, IL (US)

(73) Assignee: Pressline Services, Joliet, IL (US)

( * ) Notice: Subject to any disclaimer, the term of this patent is extended or adjusted under 35 U.S.C. 154(b) by 19 days.

(21) Appl. No.: 12/421,472

(22) Filed: Apr. 9, 2009

(65) Prior Publication Data

US 2009/0188402 A1 Jul. 30, 2009

Related U.S. Application Data

(62) Division of application No. 11/109,333, filed on Apr. 19, 2005, now Pat. No. 7,533,607.

(51) Int. Cl.
*B41F 13/14* (2006.01)

(52) U.S. Cl. ..... 101/248; 101/481; 101/216

(58) Field of Classification Search ..... 101/248, 101/481, 216

See application file for complete search history.

(56) References Cited

U.S. PATENT DOCUMENTS

| | | | |
|---|---|---|---|
| 1,745,467 | A | 2/1930 | Barber |
| 2,566,399 | A | 9/1951 | Bishop |
| 3,717,092 | A | 2/1973 | Crum |
| 4,137,845 | A | 2/1979 | Jeschke |
| 4,207,815 | A | 6/1980 | Watanabe |
| 4,336,755 | A | 6/1982 | Liska |
| 4,709,634 | A | 12/1987 | Momot et al. |
| 5,115,141 | A | 5/1992 | Gold |
| 6,543,355 | B1 | 4/2003 | Stiel |
| 6,862,986 | B2 | 3/2005 | Kersch et al. |
| 2004/0036467 | A1 | 2/2004 | May et al. |

OTHER PUBLICATIONS

"Scandrive AL," Scandrive Control AB, http://www.skf.com/files/288817.pdf, undated, two pages.

*Primary Examiner*—Leslie J Evanisko
(74) *Attorney, Agent, or Firm*—Lewis, Rice & Fingersh, L.C.

(57) ABSTRACT

A registration system for a rotary press including circumferential and sidelay registers designed to interface to the press unit using more direct motion translation. In particular, to go from rotational motion of a motor to linear motion of the adjustment with fewer transitions. Also discussed are measurement systems which measure the adjustments made to the plate cylinder more directly by measuring the linear movement of components acting on the cylinder as opposed to the movement of the motor or power source of the registration system. These systems can provide for more accurate movement to the various elements.

8 Claims, 12 Drawing Sheets

CIRCUMFERENTIAL REGISTER FOR A ROTARY PRESS

CROSS REFERENCE TO RELATED APPLICATION(S)

This application is a Divisional of U.S. patent application Ser. No.: 11/109,333, filed Apr. 19, 2005, now U.S. Pat. No.: 7,533,607, the entire disclosure of which is herein incorporated by reference.

BACKGROUND

1. Field of the Invention

This disclosure relates to the field of register systems for rotary presses, particularly for the registration of plate cylinders in newspaper presses.

2. Description of the Related Art

FIG. 1 shows a general layout of a portion of an exemplary press line (1) as might be used in any major newspaper to print pages which are primarily black and white with so-called "spot" color or occasional full color pages. The press line (1) includes at least one press unit (2), a series of angle bars (4) and a folder (121). While the press line of FIG. 1 shows two press units (2), one set of angle bars (4) and a single folder (121), most press lines will have a folder (121) and two sets of angle bars (4) with between 4 press units (2) to 10 press units (2) depending on the desired capacity and design of the press line (1). Further, a single press room may have one or more than one press line, again depending on capacity and design. The press lines may operate independently, or may operate in conjunction with each other. For the purpose of this disclosure, it will be presumed that the press line include at least one press unit (2) and any other associated structure necessary which operates in the standard manner known to those of ordinary skill in the art.

The press units (2) may be any type of press unit (2) but will generally be either standard units (3), three color units (6) (which is usually a standard unit (3) with a half deck unit (5) placed thereon), four color units (which is usually a standard unit (3) with a full deck unit (not shown) placed thereon) or tower units (not shown). The half deck (5) shown would be considered a "13 side" half deck based on its arrangement, a "10 side" half deck would be considered essentially interchangeable and would be arranged in a mirrored position. The type of press unit (2) depends upon the flexibility originally built into the press line (1). A pure black and white press line (1), for instance, will generally only have standard units (3), while a press line (1) utilizing some color (spot or process color) may have some three color units (6), four color units and/or towers. Full color press lines or press lines designed to be highly versatile, may comprise all tower press units.

Regardless of the exact press units (2) used, the press line will generally operate in a similar fashion. Paper (131) will be fed from a paper roll to the press units (2), generally from underneath the press units (2). The paper (131) will be of a predetermined width and will generally be provided on a large diameter roll containing a length many times greater than the height of any particular newspaper page. The page will generally be printed upright so that if the roll of paper is viewed before cutting, there will be a predetermined number of pages arranged side to side across the width of the roll, with the same pages repeated serially down the roll as it unwinds and is printed. The exact width of the paper roll is selected based on the width of the press unit (2) and the desired size of the resultant pages.

As the paper (131) comes up through the press unit (2), ink and dampener solution are transferred from various troughs or other storage devices onto a series of transfer rollers. Eventually the ink and dampener solution are applied to a plate cylinder (10) or (13). While the term "cylinder" is used for some components while "roller" or "drum" is used for others, this is done for convenience and does not imply any structure to any component which could not be encompassed through the use of a different term. Plate cylinder (10) or (13) includes the necessary structure to allow for the ink to be placed into the correct format so as to form the necessary text or images to be printed. This may be the actual shape to be printed (as would be the case in offset lithography) or may be a reverse image. The plate cylinder (10) or (13) then transfers the ink to blanket cylinder (11) or (12) (forming a reverse image in offset lithography) which then transfers the ink to the paper (131) printing the page. Both sides of the page are generally printed simultaneously by the two blanket cylinders (11) and (12) in a standard press unit (3). If a three color press unit (6) is used, the paper (131) may be routed past an additional plate cylinder (1801) and blanket cylinder (1800).

It is important to note that the reference numbers chosen for the plate (10), (13), and (1801) and blanket (11), (12), and (1800) cylinders in this disclosure were specifically chosen. Various references related to these cylinders utilizing these same reference numbers are known in the industry. Therefore, the choice of reference and depicted side implies which side of the press unit (2) is being viewed (and that the half deck discussed is a "13 side" half deck as opposed to a "10 side" half deck, although the description herein could be readily adapted to a "10 side" half deck). While the systems and methods can obviously be reversed if the system is being accessed from a different side, this use of reference numbers does help to provide for a particular indication of particular structure as generally no other distinguishing characteristics of the press unit (2) are used. In the case of FIG. 1 the choice of reference numbers shows that the view is from the operator side of the press.

Generally, the printing is accomplished by ink being transferred from the blanket cylinder (11), (12), or (1800) to the paper (131). In order to print cleanly, the paper (131) cannot be suspended over the blanket cylinder (11), (12) or (1800), but the blanket cylinder (11), (12), or (1800) must be allowed to push against a surface (generally another revolving cylinder) to transfer the ink to the paper (131) and cleanly print the page. In the standard press unit (3), the two blanket cylinders (11) and (12) push against each other printing both sides of the page simultaneously with each cylinder creating the surface for the other cylinder to push against. In the three color unit (6), there is included a common impression cylinder (48) which may be pressed against by any or all of the blanket cylinders (11), (12), or (1800) to provide the necessary surface.

Once the paper (131) has been printed by any particular press unit (2), it may be routed through additional press units (2) (or may go back through the same press unit (2) contacting different blanket cylinders) to add additional color or colors by contacting another blanket cylinder (11), (12), or (1800) and will eventually be routed through the angle bars (4).

Since color has been used in printing presses, the need for registration and alignment of a particular press unit has become important. As discussed above, a page will often go through more than one different press unit or will pass more than once through a press unit to obtain color on the page. The full color (or spot color) of a newspaper is often printed with a multiple color ink arrangement whereby a page passes over a first blanket roller to provide for a first color of ink, for instance black. That pass prints just the items which are in that color on the page and then passes by a different blanket roller which just prints the items which are of a next color, (for instance magenta). In a spot color page, this may be the end of the printing process, however, if the page is intended to be in full color (as is often the case with the front page for instance), the page may pass over other blanket cylinders (typically one for cyan and one for yellow) which each apply ink to their appropriate sections. As is well understood in the art, with these four colors (cyan, magenta, yellow, and black), virtually any color can be created as inks can be placed together on the same area (mixed) to generate an additional color (for instance cyan ink may be placed on a spot of yellow ink to make that spot green). The exact composition of each color in all the locations therefore generates the final color image. Therefore in most color pages of a newspaper, the page has passed over 4 individual blanket cylinders to generate the page.

Because these cylinders are spatially separated and may even be in separate press units, it is necessary to insure that each blanket cylinder prints the image aligned on the page in the same fashion as all the other blanket cylinders will print other colors on the same page. Further, even in a pure black and white single printing, it may be necessary to adjust alignment to make sure that pages are printed and aligned on both sides of the newspaper sheet to make sure that if small margins are used there is no damage to the text of the paper during cutting.

When the cylinders are correctly aligned and print on the correct area of the page so that the resultant picture is clear, the pressline is referred to as being in register. If presses are out of register, a color page will often have a colored "shadow" in the color of the misaligned press and the image will generally appear distorted as unintended color mixing has occurred. Even with spot color, there may be unintended lines of white paper or other color where the spot color or black ink has been misplaced.

While the term "register" is used to refer to correctly aligned presses, it is also the term used to refer to the devices which allow for adjusting of the positioning of the cylinders to correctly print the page. These registers traditionally come as two different types, each of which aligns the printing of one of the two dimensions of the page.

Generally, registration is performed on the plate cylinder as opposed to the blanket cylinder and printing adjustment is provided by slight movement of the plate cylinder of one press unit so that the position of the image printed by that press unit is aligned with a position of the images printed by the other press units, Circumferential registration adjusts the relationship of the printing up and down on the web. In particular, if a first cylinder is printing too high on the web, this means that the first cylinder is effectively printing the page too early on the web. The circumferential register allows the plate cylinder to be rotated about its circumference which effectively shifts the page upward or downward on the web and can correct the registration in this direction by changing the timing of when the page is printed on the web.

Alternatively, the page may be offset laterally. A sidelay register is used for this adjustment. A sidelay register serves to shift the plate cylinder laterally along its axis without rotating it. In this way the cylinder is shifted to print slightly left or right of its prior position on the web.

It is important to recognize that sidelay and circumferential adjustments are not intended to make gross movements with the various cylinders. They are instead intended to fine tune the placement of a particular press unit to correspond with the placement of other press units. Gross adjustments can be made using the compensator and related systems which are used to delay a page (by requiring it to travel a certain distance) before reaching the next press unit.

To perform circumferential adjustment, systems traditionally moved a plate gear which is used to rotate the plate cylinder during printing linearly on the plate cylinder axis and relative to the other gears in the drive train. In particular, by moving the plate gear along the axis of the plate cylinder, the plate gear is forced to engage in a slight rotation to stay in contact with the teeth of the mating gear in the drive train as the plate gear generally has helical teeth thereon. This in turn forces the plate cylinder to also rotate as it cannot be moved circumferentially relative to the plate gear as such relation is intended from the design. Therefore, small adjustments to the circumferential position of the plate cylinder can be made by applying a linear translation to the plate gear. To perform sidelay adjustment, the plate cylinder journal was traditionally linearly translated along its axis. In this situation, as the plate cylinder is being acted upon, the plate cylinder slides linearly.

From this general concept a number of different systems for performing registration have been proposed. All of these systems generally have a similar number of problems. In the first instance, generally a motor will not act directly to linearly move the plate gear or plate cylinder. Instead a motor acts on a gear train, chains, and sprockets that in turn generate the linear motion on the plate gear or the plate cylinder. All these systems generally have problems because regardless of how well gears, chains, and sprockets are designed, there is always some backlash in them and as gears wear the interrelated motion can become less accurate. Because the distances to be moved are generally very small while the material being moved is very large, even small amounts of backlash can provide for slop in the distance of adjustment. Further, many of these systems rely on hydraulic cylinders which have certain minimum amounts of movement distance and which may not be able to perform sufficiently small enough translations.

The problems become particularly acute when related to the operator's need to determine how far the system has moved. That is, the measurement of the change in registration due to the register's operation. Because the distances are small, an operator is generally forced to rely on mechanical display systems such as gauge needles to determine how far the plate cylinder has moved either axially or circumferentially. Traditionally, when measuring the amount that the register has been altered by the registration system, the system generally used the motion of the drive motor or even motion of hand wheels which can be determined to a fairly high degree of accuracy, the movement of the plate gear or plate cylinder was then calculated based on the expected operation of the gear train, As should be apparent, with even a small amount of backlash in each gear in the train, the expected adjustment and the actual adjustment can be significantly different. Further, while some backlash (which is known) can be compensated for, gears wear over time and the backlash is likely to change and therefore the measurement will become less and less accurate over time. Still further, at small amounts of movement, the problem is further compounded by other influences on the movement. For instance friction or inertia from the large components may inhibit the initial movement causing flex in various objects or gears instead of actual translation. This flex may be perceived as actual translation which may result in movement being measured where there actually is none.

A still further problem results in the measurement operation of many of these systems introducing further inaccuracy.

In many cases the measurement operation is separated from the actual movement gear train. In particular, the movement of the motor may be detected by having the motor both move a gear train which acts on the plate gear or plate cylinder and simultaneously act on a second gear train which acts on a dial or related device to show the action performed As backlash between these two gear trains may be different, the measurement readout may register a different amount than the interfacing gear train actually moves. This is on top of the fact that the gear train may actually move differently from what the motor would predict.

SUMMARY

Because of these and other problems in the art, described herein are circumferential and sidelay registers designed to interface to a press unit using more direct motion translation. In particular, the designs go from motion of the motor to motion of the adjustment with fewer calculations and transitions in most cases. Care is generally taken to provide as accurate and as fine a linear motion as possible. These systems can provide for more accurate movement to the various elements.

Systems and methods are also discussed herein for the measurement of register movement to provide improved accuracy. While the ability for fine adjustment is desirable, the best adjustment mechanism is only as effective as the measurement system associated with it. To effectively adjust the register it is desirable to both have fine movement, and to accurately determine what fine movement was actually made. This provides for both easier adjustment based on print tests as a single adjustment may be all that is needed to correctly return the press to register. Further, the systems allow for finer control as more accurate measurement allows for more accurate movement to be used efficiently. These systems can also be used to detect registration slips as they occur during a print run and to correct registration changes both on the fly and when the press is idle. In particular, the measurement systems are designed to directly measure the actual movement of the plate cylinder or plate gear by measuring the lateral displacement of the object which is displacing them or by measuring the actual movement of the desired object directly instead of measuring motor movement and calculating gear train interaction or measuring with a separate gear train. This provides for improved measurement accuracy as backlash in gearing trains is essentially removed from the calculation by occurring prior to the incidence of measurement.

Described herein, in an embodiment, is a circumferential register for a plate cylinder of a rotary press comprising: a motor for providing rotational motion; a worm shaft mechanically interconnected with the motor, the worm shaft exhibiting linear translation from the rotational motion of the motor; a bearing, the bearing connected between the worm shaft and a drive gear of the plate cylinder such that the bearing can transfer linear, but not rotational, translation; a position emitter rigidly connected to the worm shaft; and a linear transducer for detecting the linear motion of the magnet.

In an embodiment of the circumferential register the worm shaft is mechanically interconnected to the stepper motor via a gear train, the linear transducer is attached to a support which is rigidly attached to a frame of the rotary press, the position emitter comprises a magnet, or the motor comprises a stepper motor.

In an embodiment of the circumferential register, the register further comprises a control panel, the control panel being capable of instructing the motor to provide the rotational motion and can interpret output from the linear transducer. The control panel may instruct the motor based on the output from the linear transducer or may include buttons for a human user to instruct the control panel to control the rotational motion, and a display for showing the output from the linear transducer to a human user.

There is also described herein, a sidelay register for a plate cylinder of a rotary press comprising: a motor; a worm screw jack driven by the motor, the worm jack being mechanically connected to a hub supporting the plate cylinder by a drive shaft, the worm screw jack providing linear translation to the drive shaft; a position emitter attached to the drive shaft; and a linear transducer for detecting linear motion of the magnet.

In an embodiment of the sidelay register the linear transducer is attached to a support which is rigidly attached to a frame of the rotary press and may be attached to the motor, which may comprise a stepper motor. The position emitter may also comprise a magnet.

In another embodiment of the sidelay register, the worm screw jack may be connected to a clevis which is connected via a clevis pin to a mating clevis connected to the drive shaft. The worm screw jack may be keyed and the register may include a rotation bracket operationally connected to the worm screw jack to reduce any rotational motion present in the worm screw jack's linear translation.

In another embodiment of the sidelay register, the register further comprises a control panel, the control panel being capable of instructing the motor to provide the rotational motion and can interpret output from the linear transducer. The control panel may instruct the motor based on the output from the linear transducer or may include buttons for a human user to instruct the control panel to control the rotational motion, and a display for showing the output from the linear transducer to a human user.

There is also described herein, in an embodiment, a register of a rotary press comprising: means for providing linear translation, wherein the means operates to linearly translate at least one of one of a plate gear or a plate hub; and means for measuring the linear translation; wherein the means for measuring directly measures the linear translation of the means for providing linear translation.

DESCRIPTION OF PREFERRED EMBODIMENT(S)

The systems and methods will be discussed in terms of their application principally to the plate cylinders of a rotary press, in particular to a press utilizing offset lithography as the printing technique for a newspaper. One of ordinary skill in the art would understand that the techniques could also be applied to other types of rotary presses and the systems and methods here may in fact be used to provide for registration in any press system utilizing printing cylinders.

Figure 1:
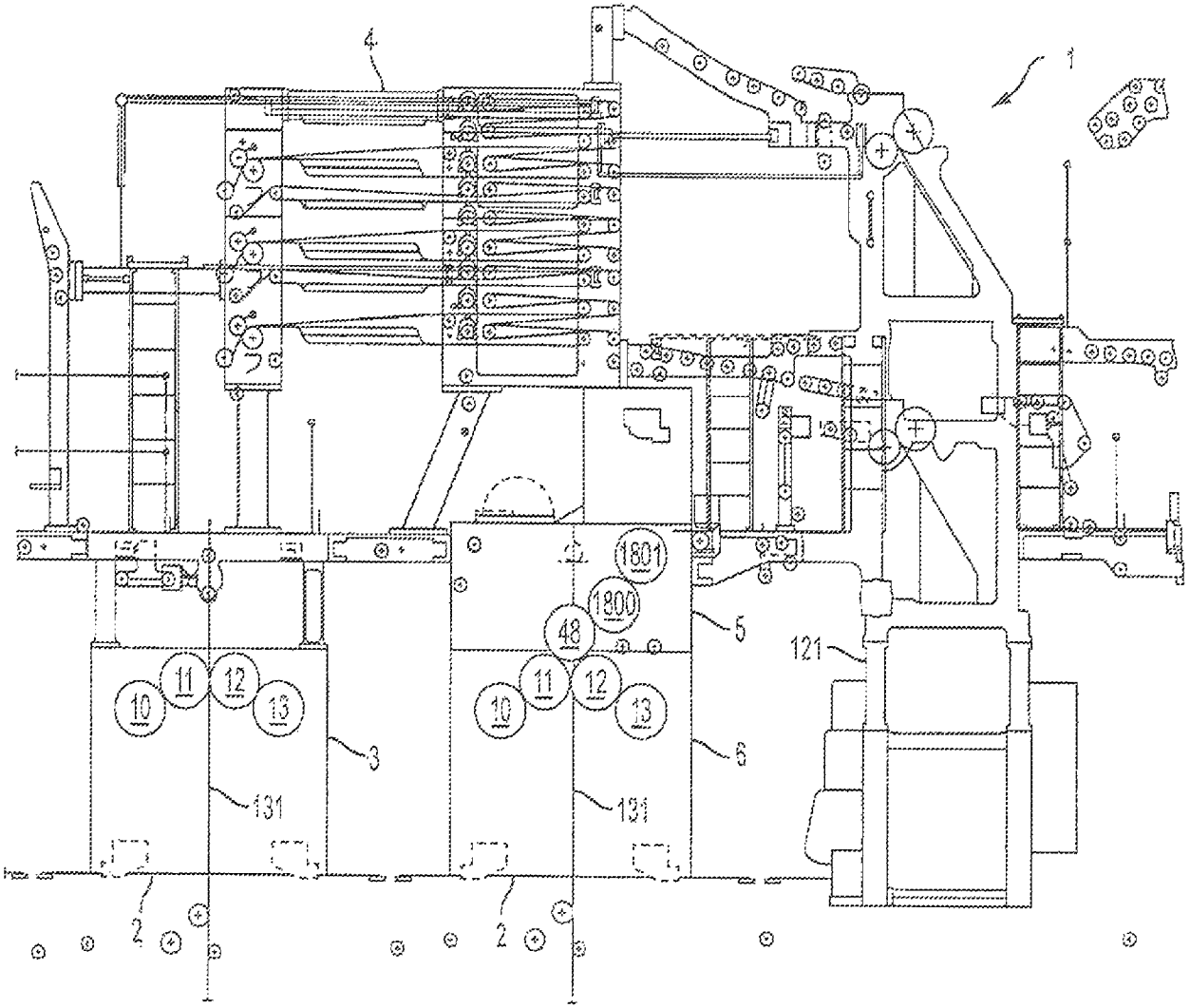
FIG. 1 PRIOR ART
FIG. 1 provides a drawing of a portion of a press line of the prior art showing two printing units (a standard unit and a three color unit (standard unit with a half-deck)) as well as a folder and some of the angle bars for interacting with the paper web.
Figure 2:
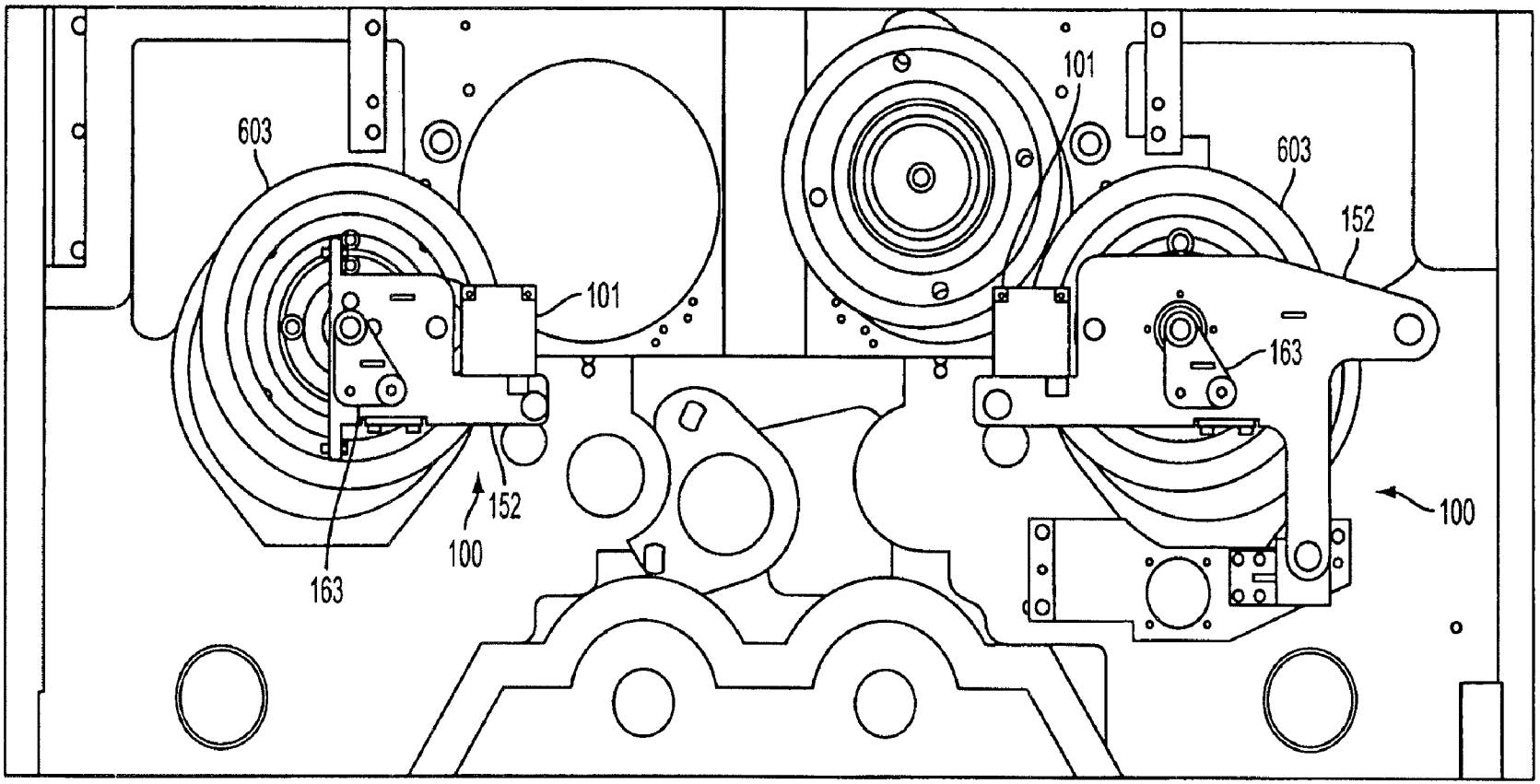
FIG. 2 provides a front view of the drive side of a press unit showing an embodiment of a circumferential register system of the present invention attached to each of the plate cylinders.
Figure 3:
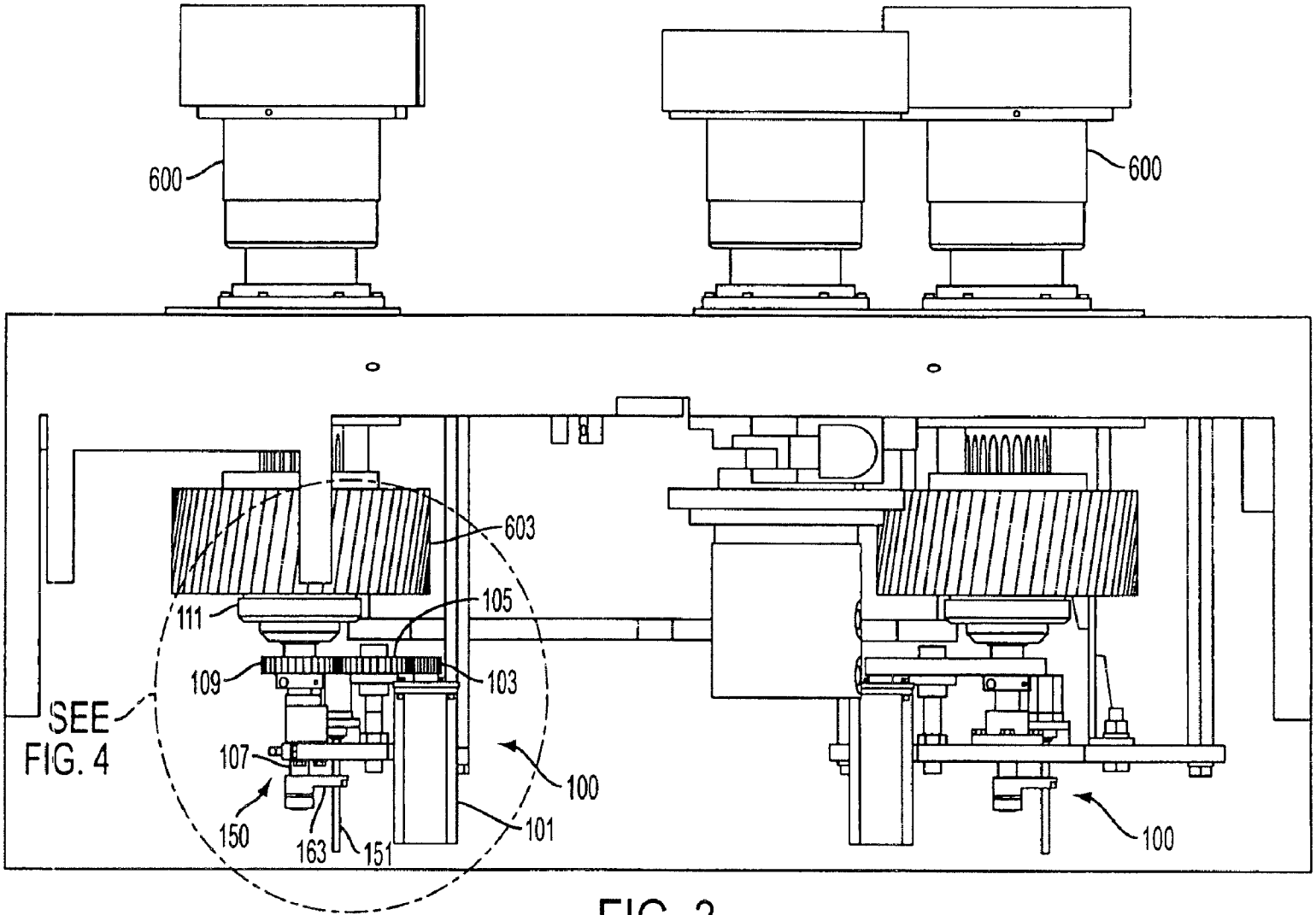
FIG. 3 provides a top view of the system of FIG. 2.
Figure 4:
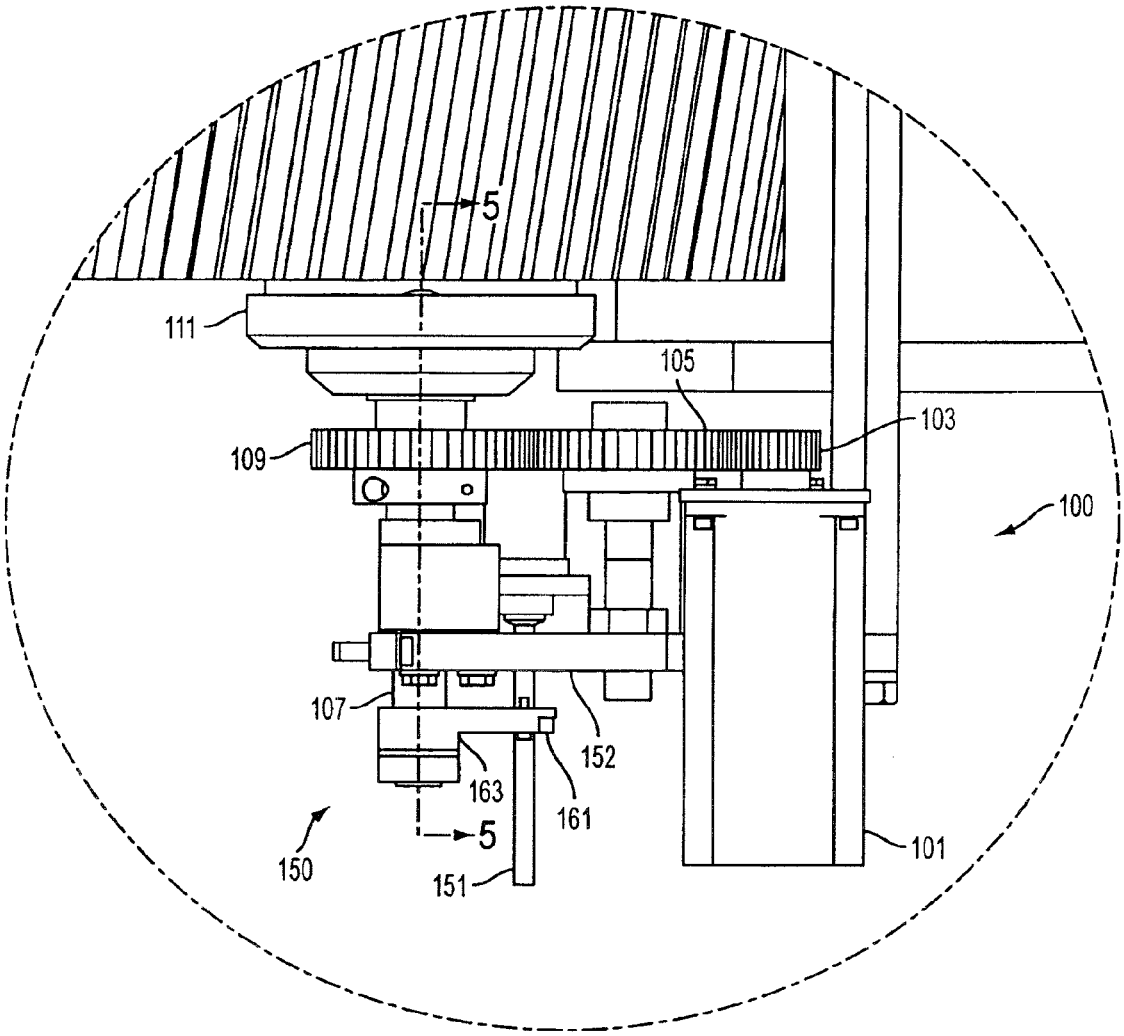
FIG. 4 provides a detail top view of one of the register systems of FIG. 2.
Figure 5:
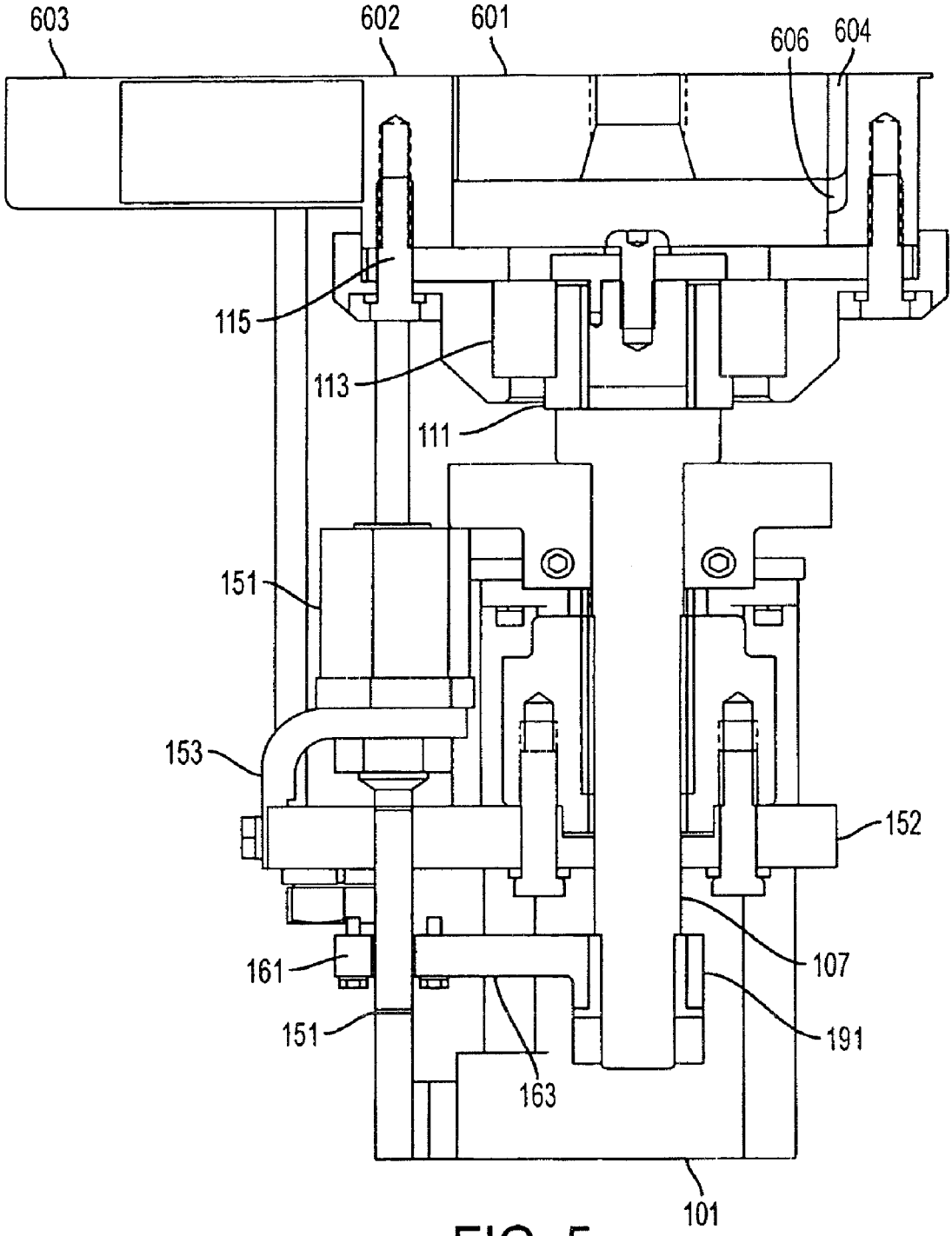
FIG. 5 provides a cutaway view along the line 5-5 of FIG. 4.
Figure 6:
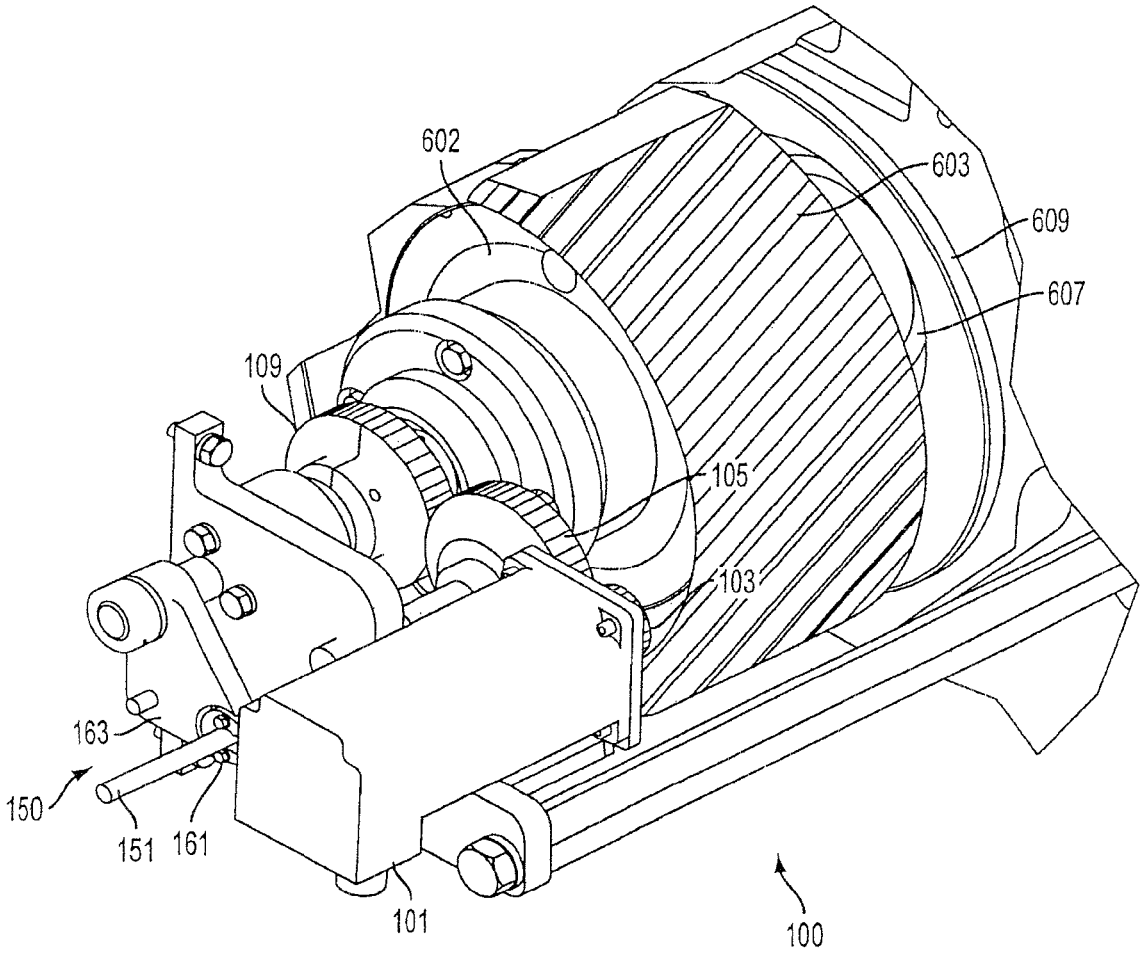
FIG. 6 provides a perspective view of the embodiment of FIG. 4
Figure 7:
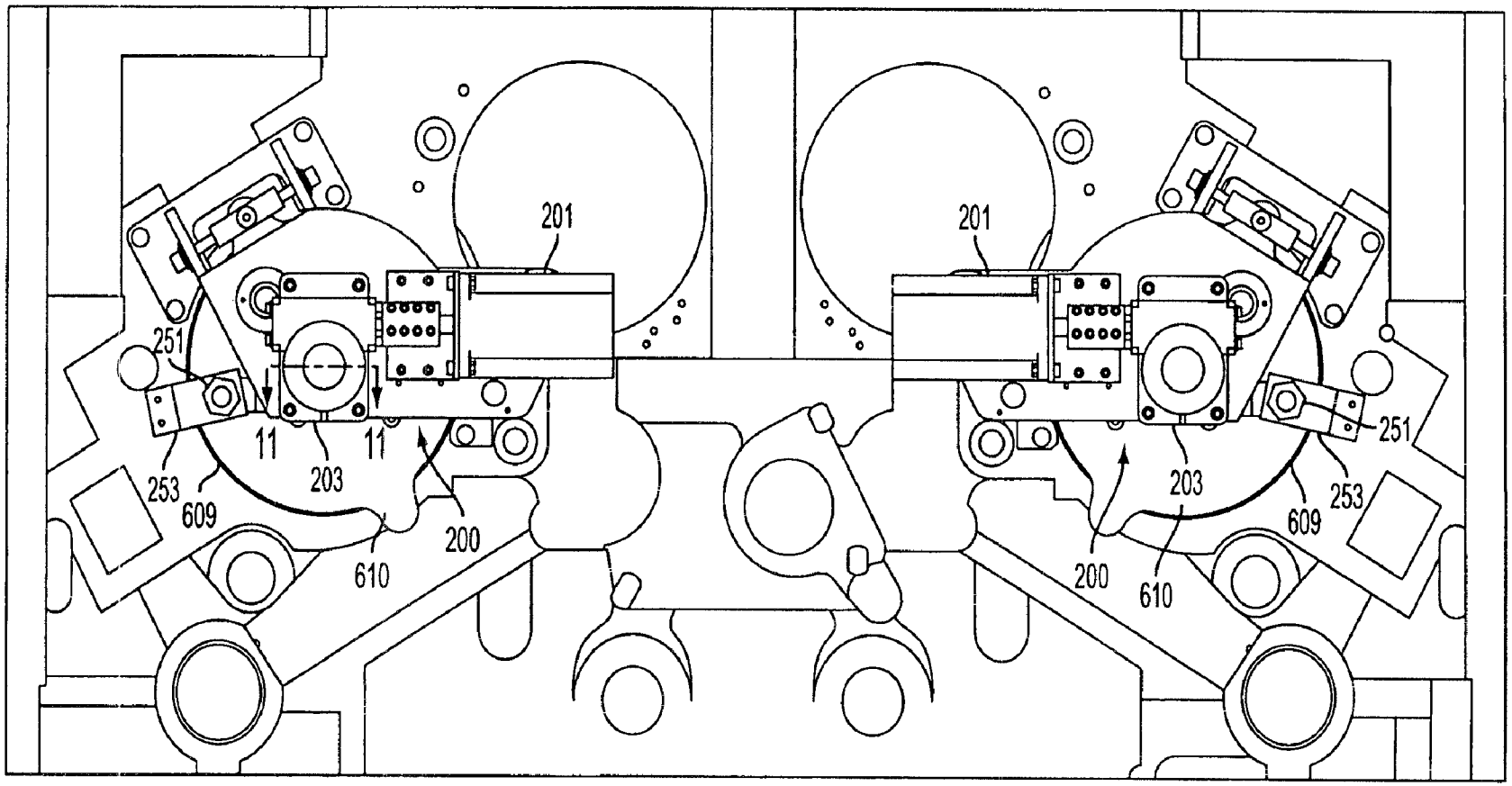
FIG. 7 provides a front view of the operator side of a press unit having an embodiment of a sidelay register system of the present invention attached to each of the plate cylinders.
Figure 8:
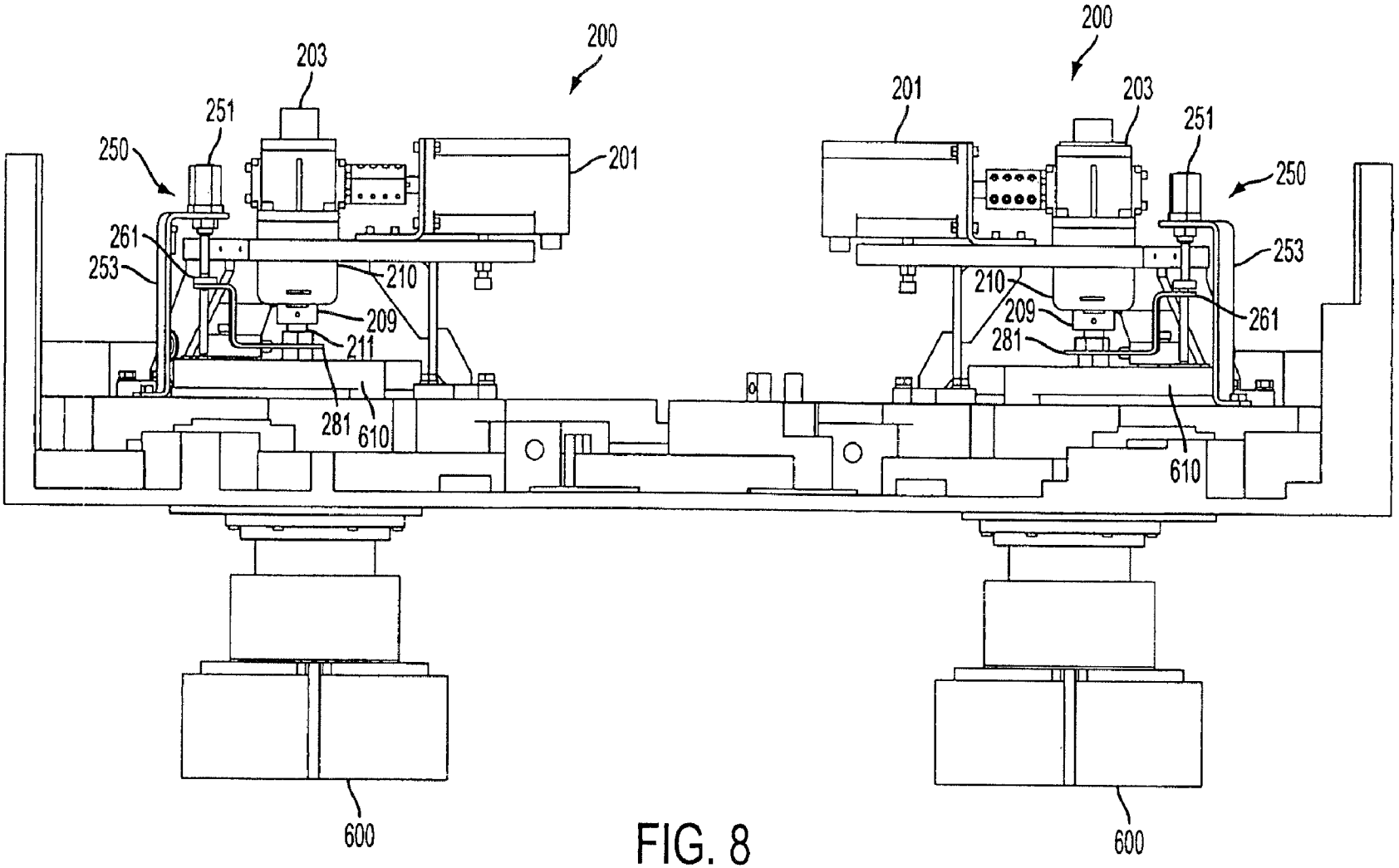
FIG. 8 provides a top view of the system of FIG. 7.
Figure 9:
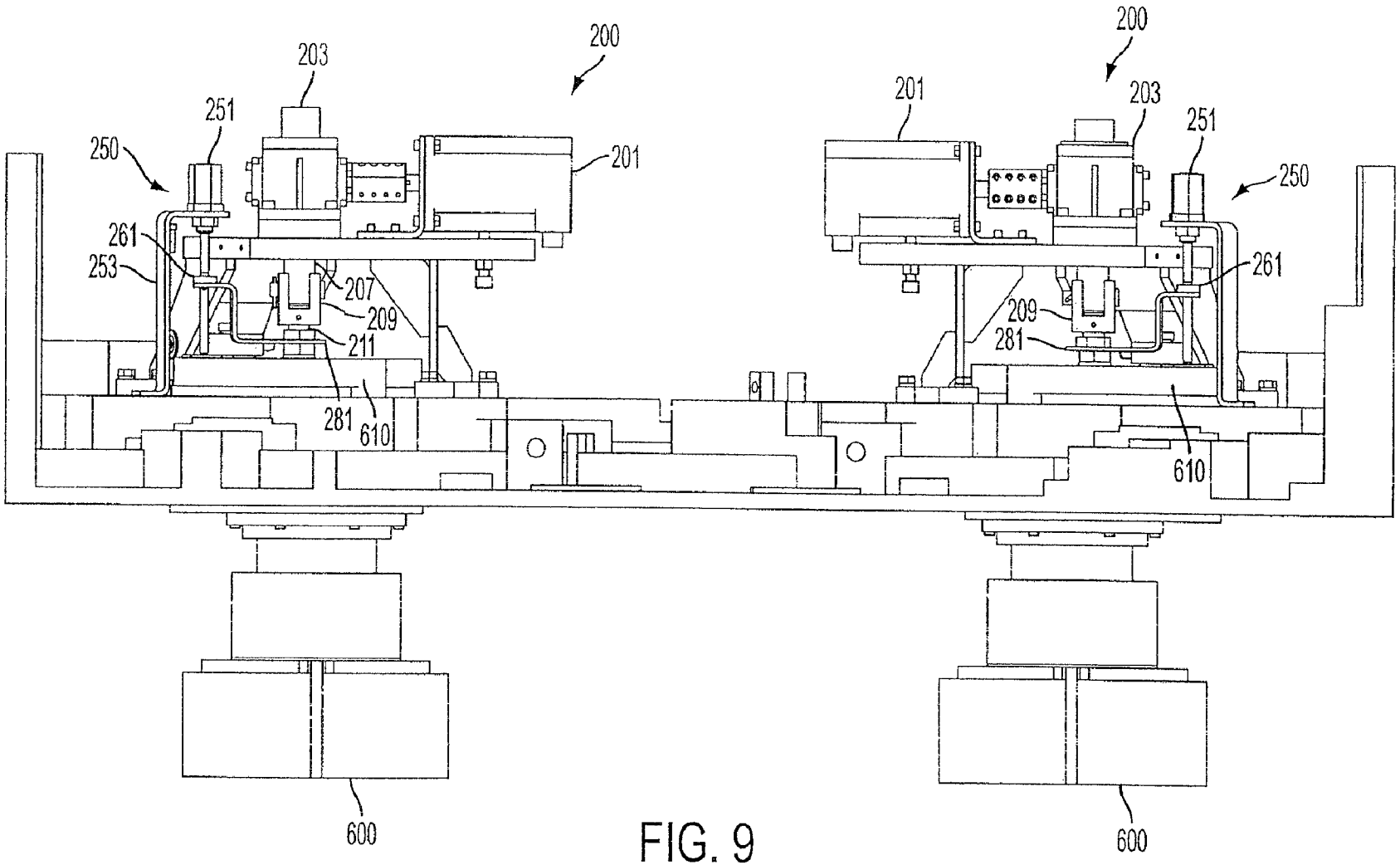
FIG. 9 provides the view of FIG. 8 with the rotation brackets removed.
Figure 10:
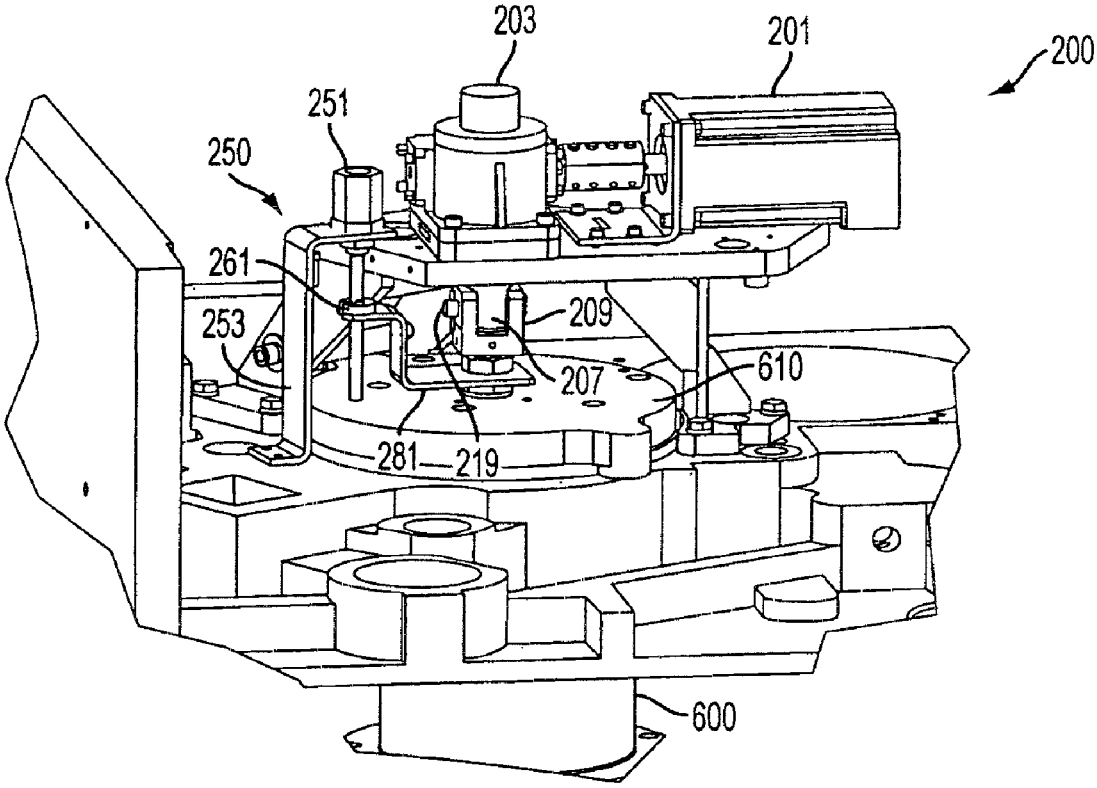
FIG. 10 provides a detail top perspective view of one of the measurement systems of FIG. 9.
Figure 11:
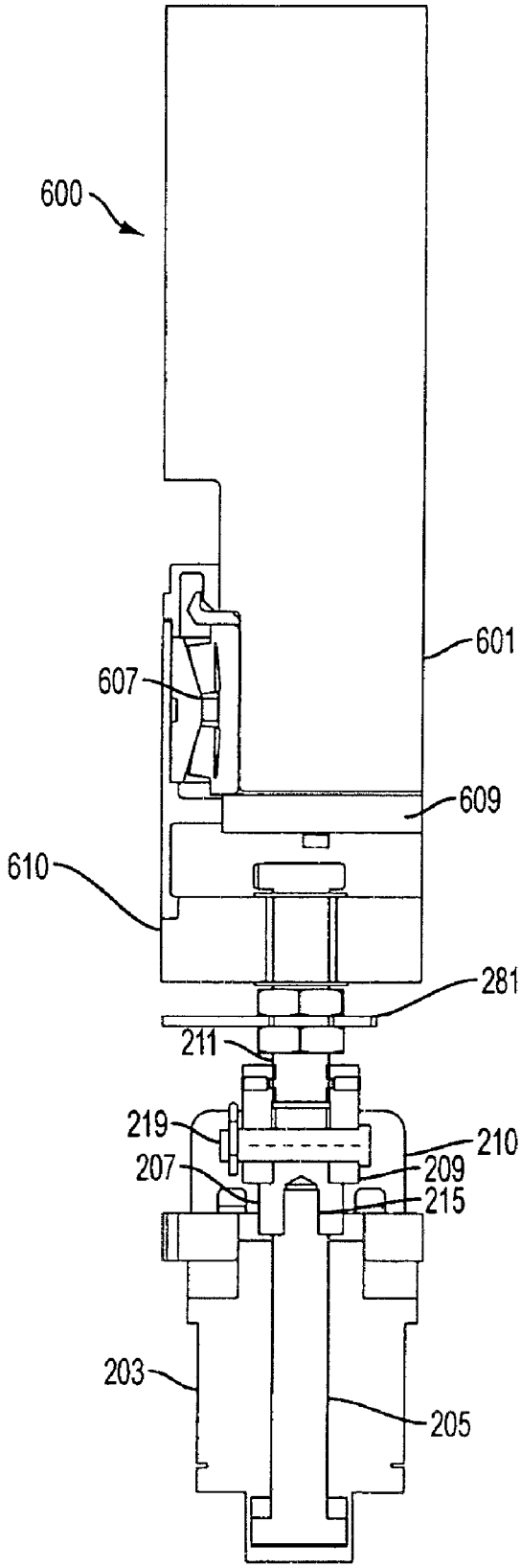
FIG. 11 provides a cutaway view along the line 11-11 of FIG. 7.
Figure 12:
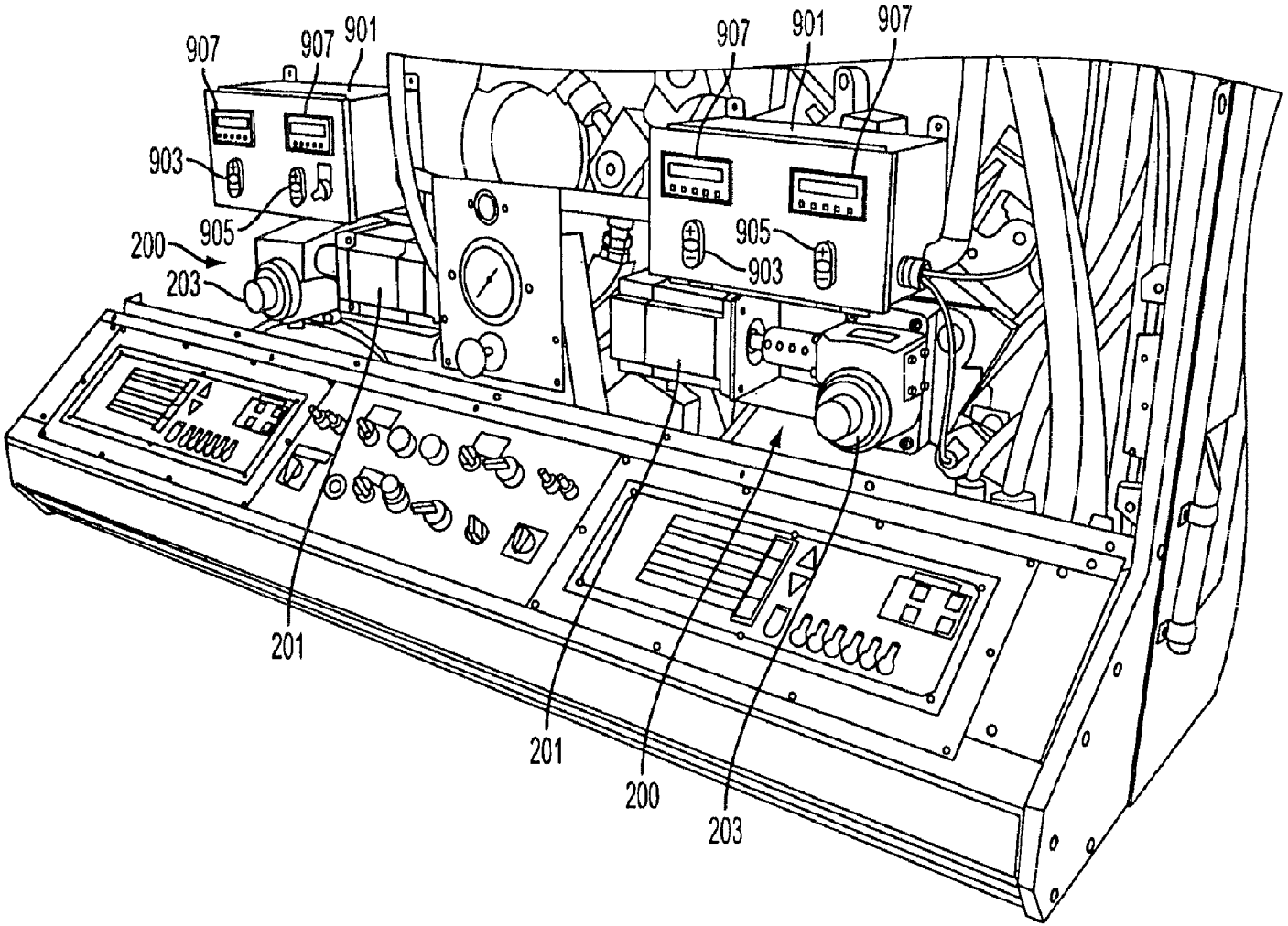
FIG. 12 provides a drawing of an embodiment of a control system and some of the registers from the operator side of the press unit and as it would appear to an operator.

The figures generally show components of a registration system for a rotary press, in particular a rotary newspaper press on a standard press unit. FIGS. 2 through 6 provide for an embodiment of a circumferential registration system while FIGS. 7 through 11 provide for an embodiment of a sidelay registration system. FIG. 12 shows how the system may appear to an operator While the system is generally discussed for operation on a standard press unit, one of ordinary skill in the art would understand that the system can be easily adapted, without undue experimentation, to be used on a half-deck, tower, or other type of rotary press unit.

FIGS. 2 through 6 show an embodiment of a circumferential register adjustment system (100) of an embodiment of a rotary press registration system. The circumferential system (100) is preferably designed to be attached on the drive side of the press as it operates on the plate gear (603) The circumferential system (100), need not be controlled from the drive side of the press, however, but may instead have various wires or cables which can connect to a control panel (901) located on the operator side of the press. The control panel (901) is designed to take in input from a user and an embodiment of a control panel (901) is depicted in FIG. 12 and is discussed later.

In most rotary presses, as shown in the FIGS , the plate cylinder (600) connects to the frame of the press by a portion of the plate cylinder designated as journals (601) which are located on each end. On the operator side of the press, the journal (601) is held by a bearing (607) inside an eccentric sleeve (609) which rests in the frame in a bore hole. On the drive side a similar arrangement is used but the drive side includes a plate gear (603), which is an externally helically toothed gear. The plate gear (603) is used to transfer motive power to the plate cylinder (600) to rotate it when printing is being carried out. Generally, the journal (601) is connected to the plate gear (603) through a hub (602) which is rigidly attached to the plate gear (603) and which attaches to the journal (601) via a tongue (604) in groove (606) or similar arrangement (commonly called a "spline") so that the journal (601) can move axially but not circumferentially relative to the plate gear (603) (and vice versa). The plate gear (603) also generally has helical teeth arranged thereon on the external surface for interfacing with the additional gears in the motive drive train. In operation, a motor driving the press unit will drive the plate gear (603) via a drive train which will then rotate causing the journal (601) end of the plate cylinder (600) therein to rotate with it The journals (601) will then rotate within the eccentric sleeves (609) at both ends in a hopefully relatively stable motion resulting in the printing of the page.

Generally, the journal (601) and plate gear (603) will interconnect using a tongue (604) and groove (606) type of arrangement with a tongue (604) being proved on the journal (601) and running axially thereto and a groove (606) to interface with the tongue being provided in a hub (602) which is then mounted internal to the plate gear (603). This arrangement provides that the plate gear (603) may move freely in the axial direction relative to the journal (601) (and vice versa), but if the plate gear (603) rotates, the journal (601), and hence the plate cylinder (600) also rotates a similar amount as the edges of the tongue (604) contact the edges of the groove (606) and cause relatively uniform rotation between the two items. The plate gear (603) will intermesh with additional drive gears (not shown) to provide for the motivation to rotate the plate cylinder (600) when the press is operating.

The circumferential register system (100) in the embodiment of FIGS. 2 through 6 comprises a stepper motor (101) providing rotational movement where each step is preferably a very small amount (⅓ of 1 degree per step is used in a preferred embodiment). The rotational shaft (103) of the stepper motor (101) is externally toothed (or attached to an externally toothed gear) and meshed with an externally toothed intermediate gear (105) which is in turn meshed with an externally toothed worm gear (109) or nut. The worm gear (109) will generally be internally threaded about a worm shaft (107) which is externally helically threaded. This type of arrangement will result in the worm shaft (107) moving linearly along its axis as it rotates from the rotation provided by the stepper motor (101).

While a small gear train comprising the intermediate gear (105) is shown in this embodiment, such a gear train is not necessary. In the depicted embodiment, however, an intermediate gear (105) is desirable because it allows for the motion of the stepper motor (101) to be further refined and decrease the rotation of the worm gear (109) with each step of the stepper motor (101). The larger the intermediate gear (105) is (or the smaller the stepper gear (103) is), the finer steps of linear translation that can be obtained from the worm shaft (107).

Generally, the circumferential register system (100) components that operate to actually produce movement of the plate gear (603) comprise a linear motion generator. In alternative embodiments, the linear motion produced by worm shaft (107) can be provided by alternative structures such as hydraulic or pneumatic cylinders or by other forms of engine or motive force. Currently, however, much more fine control can be obtained from motors which produce rotational motion rather than linear motion. Therefore, the depicted worm shaft construction is used. In an alternative embodiment, the stepper motor (101) can interface with a worm screw jack such as the worm screw jack (203) used in conjunction with the sidelay register (200) discussed later.

Returning to FIGS. 2 through 6 and specifically FIG. 5, the distal end of the worm shaft (107) is connected via a bushing or sleeve (111) to the hub (602). The sleeve (111) includes a thrust bearing (113) as the connection. The thrust bearing (113) may be of any type but will generally allow for the worm shaft (107) to rotate feely about its axis without imparting any rotational motion to the sleeve (111) (and also so that any rotational movement of the sleeve (111) does not impart motion to the worm shaft (107)) while providing that any linear translation of the worm shaft (107) is turned into corresponding linear translation of the sleeve (111). The sleeve (111) is then attached to a side of the hub (602) by use of fasteners such as screws (115).

As should be apparent, this arrangement provides for circumferential movement of the plate cylinder (600) via the circumferential register system (100) providing motive force. In particular, if circumferential adjustment is required, the user will activate stepper motor (101) which will begin stepping rotation. This will, in turn, step the gears (103), (105), and (109) in the gear train, which will cause the worm shaft (107) to move linearly in steps. As the worm shaft (107) turns, it rotates freely in bearing (113) but also moves linearly toward or away from the sleeve (111). However, because the bearing (113) is attached to the sleeve (111), the linear translation is transferred to the sleeve (111) which in turn transfers the motion to the hub (602) which transfers the motion to the plate gear (603). As this motion is along the axis of the plate gear (603) and since the plate gear (603) has helical external threads, when the plate gear (603) moves linearly, the plate gear (603) is forced to rotate by its own threads interfacing with the threads of other gears in the drive train, The drive train provides resistance to the plate gear (603) rotating the gears in the drive train. Therefore, as the plate gear (603) moves linearly it is forced to rotate. Because of the tongue (604) and groove (606) attachment of the hub (602) to the journal (601) of the plate cylinder (600), linear movement of the plate gear (603) will not be translated to the plate cylinder (600) as the hub (602) will freely slide down the tongue on the journal (601). As the plate gear (603) is forced to rotate, however, the rotational movement will therefore be translated directly to a corresponding rotational movement of the plate cylinder (600), This rotational or circumferential movement of the plate cylinder (600) will result in adjustment of the circumferential register of the plate cylinder (600).

Further, when the plate cylinder (600) is driven while printing, that motion is not translated to the worm shaft (107) unless the driving motion causes a linear translation of the plate gear (603) which causes a circumferential movement of the plate cylinder (600). When the plate gear (603) is driven during printing operations, the bearing (113) acts as a barrier prohibiting rotational movement from the plate gear (603) to be translated to the worm shaft (107). Essentially the plate gear (603) freewheels about the bearing (113). If during operation the plate gear (603) was to slip or otherwise linearly translate, which would cause a circumferential register issue, that will be immediately translated to the worm shaft (107) and will be detected by the measurement system (150) as discussed below.

In the event such a misregistration was caused while the system was in operation, the control panel (901) could detect the change in registration and can activate a warning system to indicate that the press unit's circumferential register has slipped. Alternatively, the control panel (901) could be configured to lock in a particular registration, if it detected a slip it could activate the stepper motor (101) to attempt to return the registration to its predetermined value, even while the press unit was operating.

FIGS. 2 through 6 also show an embodiment of the measurement system (150) designed for use with circumferential register system (100). As discussed above, a register system is in many respects only as accurate as the measurement of the adjustment the register system makes. Measurement system (150) is therefore designed to directly measure the linear movement of the worm shaft (107) as opposed to measuring the movement of the stepper motor (101) to eliminate much of the error inherent in existing systems. As should be apparent, as the worm shaft (107) is attached to the plate gear (603) by the hub (602), bearing (113) and sleeve (111), any linear movement of the worm shaft (107) will result in a generally similar linear movement of the plate gear (603). By measuring the linear movement of the plate gear (603) and by knowing the pitch of the teeth on the plate gear (603), the rotation of the plate gear (603) can be fairly directly and accurately determined.

The measurement system (150) in the present embodiment comprises a linear transducer (151) which is attached to a mount (153) which is in turn attached rigidly to the frame of the press unit. In the depicted embodiment, the linear transducer is supported by a rigid plate (152) that also supports the stepper motor (101). It is desirable, but not required, to attach the transducer (151) to the frame of the press unit instead of to the eccentric sleeve (609) as it helps to eliminate any movement in the transducer (151) from the eccentric sleeve (609) flexing or moving. The linear transducer (151) is acted upon by, and detects the linear movement of, a position indicator such as a magnet (161) which is mounted to a generally rigid support plate (163). The support plate (163) is then attached to the worm shaft (107) by a slip plate (191) or smooth bore which is capable of translating linear, but not rotational motion to the rigid support plate (163) from the worm shaft (107).

Therefore, in a similar manner to the movement of the worm shaft (107) relative the brace (113) and plate gear (603), the movement of the worm shaft (107) relative to the support plate (163) only allows communication of linear motion. This, in turn, is translated into linear motion of the magnet (161) whose movement relative the transducer (151) is detected by the transducer (151).

One advantage of this type of measurement system (150) is that it reduces the introduction of error due to necessary estimation from gear train backlash. Traditionally, by measuring the rotation of the motor which drove the gear train and eventually moved the plate gear (603), backlash in the gear train could result in a movement of the motor, but no actual movement of the plate gear (603) as the motor worked through the backlash. Still further, the more gearing that separated the plate gear (603) from the motor, the less accurate the determination got as each additional gear or mechanism provided for the possibility of additional backlash. Even with relatively backlash free gears, gears will wear over time and backlash will be introduced, therefore any measurement of the motor movement was necessarily inaccurate at estimating the adjustment.

The measurement system (150) not only decreases the introduction of error from backlash but also allows for some inertial compensation as part of its measurement. As should be apparent, to move the plate gear (603) requires overcoming its resting inertia, which may be considerable. In particular, the stepper motor (101) may step and exert force on the gear train, but until the worm shaft (107) overcomes the inertia there may be a build up of stored energy in the worm shaft (107) or gear train which has not yet been actually translated to linear movement of the worm shaft (107). As the motion of the worm shaft (107) is directly measured, the measurement system (150) will therefore not register any movement until the worm shaft (107) actually translates. Therefore, stored force from shaft wind up or similar phenomena is not registered by the measurement system (150) as movement. This is particularly important in small adjustments. If sufficiently small adjustments are made, motion of the motor may be entirely stored in the worm shaft with no translation as the force is insufficient to overcome resting inertia. As this measurement system does not indicate movement for stored force the user can quickly detect that no movement has been made and additional force is required. Further, due to resting inertia, it may not be possible to translate a very small amount, as the force required to overcome the resting inertia may, once the inertia is overcome, move the plate gear (603) too far. Again this can be detected by the operator who may need to adjust overly and then return to the desired register, an action which is very difficult with motor measurement systems.

Another benefit of this more direct measurement system (150) is that it eliminates any error due to differences between the measurement and the actual translation. As has been discussed previously, in some devices (particularly those where registration used hand wheels to provide motive force) the distance moved was indicated by a gauge which had its own gear train separate from the gear and sprocket train which drove the actual movement. In this case, the movement indication was doubly inaccurate as not only was error introduced to the actual movement from the backlash and stored force, a different error was introduced by different backlash and stored force in the measurement gear and sprocket train. In effect, particularly for small movements, the measurement was, at best, a guess as to the actual distance moved. In this situation, it was therefore necessary to perform multiple adjustments checking to see where the registration ended up after each adjustment. A user could generally only approximate how much adjustment had been made. This means that while the user knew what adjustment needed to be made, he could not necessarily perform it. The above system eliminates many of these problems by more directly measuring the actual linear displacement.

FIGS. 7 through 11 show an embodiment of a sidelay register (200). In the depicted sidelay register (200), the linear motion of the plate cylinder (600) is accomplished through the use of a conventional worm screw jack (203) which is designed to interface with the cover plate (610) and eccentric sleeve (609) which is in contact with the bearing (607) which is in turn in contact with the journal (601) of the plate cylinder (600). The sidelay register (200) is generally similar to the circumferential register (100), except that the worm shaft (107) of the circumferential register (100) and the intermediate gear (105) and worm gear (109) are incorporated into a conventional worm screw jack (203).

This is by no means required and the sidelay register (200) in another embodiment can use a worm shaft (107) as discussed in conjunction with the circumferential register (100). In still another embodiment, the sidelay register (200) may use another alternative linear motion generator as discussed previously in conjunction with the circumferential register (100). The worm screw jack (203) is however generally a preferred arrangement as it allows for otherwise available components to be used as part of the register system.

In an embodiment, the worm screw jack may be of the type manufactured commercially such as under the name Actionjac™ by Nook Industries. In an embodiment, the ratio of the worm screw jack (203) is preferably selected to be 24 to 1 or greater to provide for sufficiently fine movement. The worm screw jack (203) is driven by another stepper motor (201) which may be of similar design to that used in the circumferential register (100).

In the sidelay register (200), the worm screw jack (203) has the distal end (215) of the screw (205) connected to a clevis (207), which is in turn connected to a mating clevis (209) by a clevis pin (219). The mating clevis (209) is connected to a drive shaft (211). This allows the worm screw jack (203) to be quickly separated from the drive shaft (211), if desired, for maintenance or inspection. The worm screw jack (203) is preferably keyed and therefore produces only linear motion with relatively minimal rotational motion. In this case, no thrust bearing is required in the connection so the clevis (207) and mating clevis (209) may be used without one In an alternative embodiment a thrust bearing may be included. Even with a keyed worm screw jack (203), a small amount of rotation may still be present. To eliminate any remaining rotation and provide for fine movement, there is included a pair of rotation brackets (210). The rotation brackets (210) are in contact with flat surfaces of the mating clevis (209) and prohibit it from rotating, thereby eliminating any remaining rotational motion from the worm jack (203).

The drive shaft (211) has mounted thereon a mounting bracket (281) which is used by the measurement system (250). The drive shaft (211) is also rigidly connected to the cover plate (610) which is connected to the eccentric sleeve (609) which holds the journal (601) of the plate cylinder (600). In the depicted embodiment, the eccentric sleeve (609) is on the operator's side of the press unit so that there is no plate gear (603) shown, but that is not necessary and the sidelay register (200) may be alternatively mounted on the drive side. However, having the circumferential register (100) and sidelay register (200) on opposite sides of the press unit provides that each has a larger area that it can occupy making the system easier to maintain and inspect.

As discussed previously, the eccentric sleeve (609) will generally be attached to the journal (601) in a manner that allows the journal (601) to rotate within a bore in the eccentric sleeve (609), but which does not allow the two components to move linearly relative to each other, Therefore, in this situation, the rotational movement of the worm screw jack (203) is eliminated by the rotation brackets (210) and therefore the mounting bracket (281) moves linearly. The linear motion of the screw (205), however, is translated directly to the drive shaft (211) which in turn pushes on a cover plate (610) which pushes on the eccentric sleeve (609) and plate cylinder (600) to linearly translate them both. As this linear motion is generally along the axis of the plate cylinder (600), this results in the plate cylinder (600) being transposed linearly along its axis.

During operation of the press, the plate cylinder's (600) rotational motion would again be isolated from the drive shaft (211) by the bearing (607) in the eccentric sleeve (609). In particular, the journal (601) could freely rotate within the eccentric sleeve without any rotational translation being provided to the eccentric sleeve (609). If, however the plate cylinder (600) was to linearly translate, it would usually also cause the eccentric sleeve (609) and the drive shaft (211) to translate. This linear translation would be detected by the measurement system (250) which, as discussed above in conjunction with the circumferential register (100), could trigger an alarm or serve to activate the control panel (901) to attempt to return the system to register.

The sidelay register (200) includes a measurement system of similar design to that used in the circumferential register system (100) discussed above. In this embodiment, a linear transducer (251) is again used which is attached to the frame of the press, in this case through the use of support (253). The drive shaft (211) (which may be a threaded screw for ease of assembly), as discussed above, has a mounting bracket (281) attached thereto, preferably on the journal (601) side of the mating clevis (209). The mounting bracket (281) moves with the drive shaft (211) and is therefore linearly translated as the drive shaft (211) translates to perform the registration. Toward the upper end of the mounting bracket (281) there is mounted a position emitter such as a magnet (261). The magnet (261) is allowed to translate with the linear movement of the drive shaft (211) relative to the linear transducer (251) which allows the linear transducer (251) to detect linear translation of the drive shaft (211) and thus the linear translation of the eccentric sleeve (609) and plate cylinder (600). As should be apparent, if the drive shaft (211) does not move because the plate cylinder's (600) resting inertia has not been overcome or if there is backlash within the worm screw jack (203), the measurement system will not read any movement, although the stepper motor (201) may have turned.

The circumferential (100) and sidelay (200) register systems discussed herein will generally be controlled by a control panel (901), to provide a user with both inputs to control the movement of the sidelay and circumferential register systems as well as to allow them to monitor the change in position. An embodiment of a control panel (901) is shown in FIG. 12 as a complete registration system may appear to the operator. In FIG. 12, there are two control panels (901), one for each of the plate cylinders (600) in a standard press unit. The sidelay registration systems (200) are also visible. The circumferential registration systems (100) on the opposing side of the press unit are not visible. Each control panel (901) has sidelay control (903) and a circumferential control (905) for the associated plate cylinder (600). The sidelay movement will therefore generally be moved independently of the circumferential movement.

The control panel (901) in the embodiment of FIG. 12 is designed to take input from a user by the user pressing an indicator button (903) or (905) indicating the direction that the user wants the plate cylinder (600) to move. The control panel (901) will initiate movement at the user's command by instructing the stepper motor (101) or (201) to begin stepping. The user will then generally watch the display (907) on the control panel (901) which will indicate the distance that the appropriate register system has moved the plate cylinder. When the readout (902) shows the desired level of adjustment, the user will cease pushing the button (903) or (905) and the control panel (901) will cease instructing the appropriate register (200) or (100) to perform adjustment.

The control panel (901) shown in FIG. 12 merely provides one embodiment of a control panel (901) that may be used to control sidelay (200) and circumferential (100) registers as shown above, the advantage of the user carrying out manual control until the desired change is made is that if a very small adjustment is required, the user may be able to rock the register control back and forth (to take up and measure after the backlash or resting inertia has been overcome) to make the desired adjustment. A control panel (901) may allow the user to adjust the register during operation or when idle. In particular, the user may see that the display (907) value changes if the register (200) or (100) slips during printing. They can then move the register (200) or (100) back through manual control or automatic systems.

In an alternative embodiment, however, the control panel (901) may be of a different type to that shown in FIG. 12 and described above. For instance, the control panel (901) may allow the user to dial in a particular desired total registration movement, and then the control panel (901) will automatically adjust the sidelay (200) and circumferential register (100) until the measurement of adjustment is the prestated amount. This type of correction can allow a user to determine the necessary register change based on test pages and then simply dial in the change, possibly running another test to make sure it has been corrected appropriately once the control panel (901) has completed its adjustment.

It should be recognized, that the measurement systems (150) and (250) discussed herein do not provide for a perfect measurement of actual adjustment but generally provide for more accurate measurement than systems which measure the translation less directly. There is still the possibility of backlash or slippage between the drive shaft (211) and the journal (601) in the sidelay register (200) or between the plate gear (603) and the drive train in the circumferential register (100), for instance. The measurement systems (150) and (250) do, however, generally provide for improved accuracy of measurement over other systems where these errors were compounded by additional error due to indirect measurement and lack of compensation for backlash and inertial issues. Measurement systems (150) and (250) generally of the design discussed in the present embodiments have been tested and can, in some embodiments, accurately determine positioning of the plate cylinder (600) to within a few thousandths of an inch. This is usually smaller than what is detectable to the human eye in the resultant printing.

Because of the improved accuracy of adjustment, the ability to register is simplified. In particular, with improved measurement, the system will often be accurate enough to hit a target registration on a first attempt. In particular, the need for registration is often determined by printing a test page; the test page can then be measured to determine the amount of registration correction necessary. If the registration is adjusted by an amount equal to the measurement of correction needed, there is no need to test again. The ability to only need a single registration adjustment provides for dramatic savings of labor on the part of an operator as the operator does not need to measure the necessary adjustment to be made and make what they think is the correct adjustment, run another test, and then attempt to make a further adjustment based on the difference between the adjustment that was measured and the adjustment that actually occurred.

While the invention has been disclosed in connection with certain preferred embodiments, this should not be taken as a limitation to all of the provided details. Modifications and variations of the described embodiments may be made without departing from the spirit and scope of the invention, and other embodiments should be understood to be encompassed in the present disclosure as would be understood by those of ordinary skill in the art.

The invention claimed is:

1. A circumferential register adjustment device for a plate cylinder of a rotary press comprising:

a motor for providing rotational motion;

a worm shaft mechanically interconnected with said motor, said worm shaft exhibiting linear translation from the rotational motion of said motor;

a bearing connected between said worm shaft and a drive gear of said plate cylinder such that said bearing transfers linear, but not rotational, translation to the drive gear due to movement of the worm shaft;

a position emitter rigidly connected to said worm shaft; and a linear transducer for detecting the linear translation of said position emitter wherein said linear translation of said drive gear results in rotation of said drive gear and this rotation of said drive gear will be translated into a corresponding rotation of said plate cylinder so as to adjust said circumferential register of said plate cylinder; and wherein said linear translation of said worm shaft is directly measured and the linear translation of said worm shaft is used to determine the amount of rotation of said plate cylinder that was made to adjust said circumferential register.

2. The device of claim 1 wherein said worm shaft is mechanically interconnected to said motor via a gear train.

3. The device of claim 1 wherein said linear transducer is attached to a support which is rigidly attached to a frame of said rotary press.

4. The device of claim 1 wherein said motor comprises a stepper motor.

5. The device of claim 1 further comprising a control panel, said control panel being capable of instructing said motor to provide said rotational motion and can interpret output from said linear transducer.

6. The device of claim 5 wherein said control panel instructs said motor based on said output from said linear transducer.

7. The device of claim 6 wherein said control panel includes buttons for a human user to instruct said control panel to control said rotational motion, and a display for showing said output from said linear transducer to a human user.

8. The device of claim 1 wherein said position emitter comprises a magnet.

* * * * *